US009907374B2

(12) United States Patent
Canaday et al.

(10) Patent No.: US 9,907,374 B2
(45) Date of Patent: Mar. 6, 2018

(54) APPARATUSES AND METHODS FOR FINANCIAL TRANSACTION CARD DISPLAYS

(71) Applicant: HOME DEPOT PRODUCT AUTHORITY, LLC, Atlanta, GA (US)

(72) Inventors: Jessica Canaday, Smyrna, GA (US); Nichole A. Flynn, Park Ridge, IL (US)

(73) Assignee: Home Depot Product Authority, LLC, Atlanta, GA (US)

( * ) Notice: Subject to any disclaimer, the term of this patent is extended or adjusted under 35 U.S.C. 154(b) by 438 days.

(21) Appl. No.: 14/200,934

(22) Filed: Mar. 7, 2014

(65) Prior Publication Data

US 2015/0250278 A1 Sep. 10, 2015

(51) Int. Cl.
*B65D 73/00* (2006.01)
*A45C 11/18* (2006.01)

(52) U.S. Cl.
CPC ..... *A45C 11/182* (2013.01); *B65D 73/0028* (2013.01); *Y10T 29/49815* (2015.01)

(58) Field of Classification Search
CPC ..... A45C 11/18; A45C 11/182; A45C 11/186; A45C 11/188; B65D 73/0028; B65D 73/00; B65D 73/0007; B65D 73/0014; B65D 73/0021; B65D 73/0035; B65D 73/0042
USPC ..... 206/495, 521, 583, 587, 588, 591, 592, 206/806; D7/9, 10, 11, 12; 40/124.06
See application file for complete search history.

(56) References Cited

U.S. PATENT DOCUMENTS

| | | | | |
|---|---|---|---|---|
| 3,777,444 | A * | 12/1973 | Dunn | B24D 15/04 15/209.1 |
| 3,813,231 | A | 5/1974 | Gilbert et al. | |
| 4,271,973 | A * | 6/1981 | Quagliaro | B65D 51/1616 215/261 |
| 4,401,258 | A * | 8/1983 | Buchler | B42D 15/0093 206/454 |
| D365,847 | S | 1/1996 | Milne et al. | D19/5 |
| D438,563 | S | 3/2001 | Webb et al. | D19/10 |
| 6,382,676 | B1 * | 5/2002 | Cochran | G09F 3/04 206/460 |
| 6,708,434 | B1 * | 3/2004 | Zarrow | B65D 73/0064 383/84 |
| D497,636 | S | 10/2004 | Allen et al. | D19/10 |
| 6,877,263 | B2 | 4/2005 | Clark | 40/124.06 |
| D517,602 | S | 3/2006 | Brink et al. | D19/9 |
| D526,012 | S | 8/2006 | Dorr et al. | D19/9 |
| D569,423 | S | 5/2008 | Lasch et al. | D19/9 |
| D582,475 | S | 12/2008 | Guest | D19/10 |
| D593,600 | S | 6/2009 | Lasch et al. | D19/10 |
| D622,763 | S | 8/2010 | Lamm et al. | D19/9 |
| D632,735 | S | 2/2011 | McGrane et al. | D19/10 |

(Continued)

*Primary Examiner* — Steven A. Reynolds
*Assistant Examiner* — Javier A Pagan
(74) *Attorney, Agent, or Firm* — Greenberg Traurig, LLP

(57) ABSTRACT

This disclosure includes displays for financial transaction cards, and related methods. Some embodiments of the disclosed displays include an upper hanging tab configured to be releasably coupled to a financial transaction card; a lower enclosure detachably coupled to the hanging tab and defining an opening; and a card holder movably disposed within the enclosure and accessible through the opening, the card holder configured to be releasably coupled to a financial transaction card. In some of the disclosed displays, at least one surface of the enclosure comprises a sandpaper texture.

20 Claims, 8 Drawing Sheets

(56) References Cited

U.S. PATENT DOCUMENTS

| | | | | |
|---|---|---|---|---|
| 8,672,129 | B2 * | 3/2014 | Glass | B65D 5/0005 206/461 |
| 8,905,233 | B2 * | 12/2014 | Glass | B65D 73/0007 206/460 |
| 2003/0070332 | A1 * | 4/2003 | Santa Cruz | G09F 1/00 40/124.01 |
| 2007/0246527 | A1 * | 10/2007 | Tang | B65D 75/00 235/380 |
| 2007/0261989 | A1 * | 11/2007 | Stoles | B65D 85/00 206/767 |
| 2007/0267313 | A1 | 11/2007 | McLean | 206/457 |
| 2010/0018090 | A1 | 1/2010 | Dickert | 40/124.08 |
| 2010/0044258 | A1 * | 2/2010 | Siecke | G11B 33/0444 206/308.1 |
| 2012/0241348 | A1 | 9/2012 | Clegg | 206/486 |
| 2013/0074388 | A1 | 3/2013 | Glass et al. | 40/672 |
| 2013/0087621 | A1 | 4/2013 | Vogt | 235/488 |
| 2013/0153454 | A1 | 6/2013 | Glass et al. | 206/457 |
| 2013/0240134 | A1 * | 9/2013 | Flynn | G09F 3/10 156/227 |
| 2014/0231278 | A1 * | 8/2014 | Glass | B65D 73/0078 206/39 |

* cited by examiner

APPARATUSES AND METHODS FOR FINANCIAL TRANSACTION CARD DISPLAYS

BACKGROUND

1. Field of Invention

This disclosure relates generally to financial transaction cards and more specifically, but not by way of limitation, to displays for financial transaction cards.

2. Description of Related Art

Examples of gift card displays are disclosed in U.S. Pat. No. D622,763, and U.S. patent application Ser. No. 13/429,308.

Various financial transaction cards (e.g., gift cards, credit cards, debit cards, and/or the like) are commonly available. For example, gift cards are a popular gift, and gift card sales increase every year. Currently, the gift card industry is valued at approximately one hundred billion dollars and is expected to grow. Typically, gift cards are issued by retailers with a specified value and allow a recipient of the gift card to exchange that value for goods or services. Often times, gift cards are given as gifts and can mitigate, for the giver, the anxiety and time expenditures generally associated with procuring a traditional gift. For example, procuring a traditional gift involves time spent in selecting, locating, and purchasing the gift. On the other hand, purchasing a gift card can involve substantially less investment. For example, a purchaser can select a store at which the intended recipient frequently shops. The purchaser can then select a gift card from a store rack within the store. Next, a cashier can accept value from the purchaser (e.g., money) and assign that value to the gift card. This process is generally accomplished through use of unique identifying features on the gift card, such as Universal Product Codes (UPCs), magnetic strips, quick response (QR) codes, and/or the like that are unique to each individual gift card. For example, the cashier can scan the unique identifying features to associate the value received with the gift card in the retailer's computer system. In less-common stored-value card systems, the value of the card can be stored within the card itself (e.g., on a memory) as opposed to within the retailer's computer system. The purchaser can then gift the card to the recipient, who may then redeem the value for goods or services (e.g., by debiting against the value associated with the card as stored in the retailer's computer system). Gift cards can thus facilitate the recipient in receiving a desired gift and minimize time and anxiety for the purchaser in the gift selection process.

Gift cards can be printed with a design and/or a logo for aesthetic or advertising purposes. Additionally, gift cards can come in a variety of shapes and sizes; however, most comprise a rectangular shape resembling a credit card for easy storage (e.g., within a wallet). At the time of purchase, gift cards are generally disposed on a flat piece of material, such as card stock, to facilitate placement on store displays. In some instances, the flat piece of material is foldable to form a basic envelope around the gift card at the time of gifting. Gift cards can be perceived by some as a less sincere or impersonal gift and directly gifting a gift card as purchased may aggravate this perception. Therefore, a purchaser may seek to additionally purchase a traditional card and envelope to contain the gift card for gifting, which may improve the presentation of the gift and provide room to write a personalized message to the recipient.

In 2012, approximately two billion dollars in gift card value went unredeemed. This may be, in part, due to gift cards becoming lost or forgotten as a result of their relatively small size. While some gift cards are provided with a basic envelope at purchase, such envelopes are generally made of a thin material and may not be capable of surrounding the gift card on all sides and therefore may allow the gift card to slip out of the envelope and become lost. Placing the gift card into a traditional envelope as described above may help prevent such loss by fully surrounding the gift card and increasing the physical size of the gift package, however, such envelopes are generally designed to be destroyed and discarded when opened.

SUMMARY

Embodiments of the apparatuses and methods in this disclosure can be configured to allow both time-efficient purchases of gift cards (and/or other financial transaction cards) and complete gift packaging in a single gift card display through an upper hanging tag configured to be releasably coupled to a gift card (e.g., such that identifying features of the card can be scanned or otherwise accessed without removing the card from the hanging tab), an enclosure that can surround the gift card on all sides, and a removable card holder movably disposed within the enclosure that can further secure the gift card (e.g., and provide an additional surface for a giver to add a personalized message to a recipient). Through use of the apparatuses (e.g., displays) in this disclosure, gift presentation can be improved, a purchaser can avoid costs associated with purchasing additional packaging, and the risk of gift card loss can be reduced. While certain of the embodiments of the card displays in this disclosure are described with reference to gift cards, such displays can also be used with other types of financial transaction cards.

Some embodiments of the disclosed displays (e.g., for a financial transaction card) comprise: an upper hanging tab configured to be releasably coupled to a financial transaction card; a lower enclosure detachably coupled to the hanging tab and defining an opening; and a card holder movably disposed within the enclosure and accessible through the opening, the card holder configured to be releasably coupled to a financial transaction card. In some embodiments, the hanging tab is configured to be releasably coupled to the financial transaction card such that at least one identifying feature of the financial transaction card is accessible. In some embodiments, the hanging tab is coupled to the enclosure by an adhesive. In some embodiments, the hanging tab is coupled to the enclosure along a perforated seam. In some embodiments, the enclosure comprises: a flap movable between open and closed positions to selectively cover the opening; and a slot configured to releasably receive a portion of the flap to retain the flap in the closed position. Some embodiments comprise: a ribbon or string disposed around the enclosure. Some embodiments further comprise: a gift tag coupled to the ribbon or string. In some embodiments, at least one surface of the enclosure comprises a sandpaper texture.

In some embodiments of the disclosed displays, the card holder comprises a tab configured to extend out of the opening when the card holder is disposed in the enclosure to facilitate removal of the card holder from the enclosure. In some embodiments, the card holder comprises a recess configured to removably receive the financial transaction card. In some embodiments, the recess comprises a surface configured to receive ink from a writing utensil. In some embodiments, the recess comprises a hole configured to facilitate removal of the financial transaction card from the card holder. In some embodiments, the card holder comprises an adhesive configured to releasably couple the financial transaction card to the card holder. Some embodiments further comprise: a financial transaction card releasably secured to the hanging tab by an adhesive.

Some embodiments of the disclosed apparatuses comprise: an enclosure defining an opening; and a card holder movably disposed within the enclosure and accessible through the opening, the card holder configured to be releasably coupled to a financial transaction card; where at least one surface of the enclosure comprising a sandpaper texture. In some embodiments, the card holder comprises a recess configured to receive the financial transaction card, and the apparatus further comprises: a financial transaction card removably received within the recess of the card holder. In some embodiments, the enclosure comprises: a flap movable between open and closed positions to selectively cover the opening; and a slot configured to releasably receive a portion of the flap to retain the flap in the closed position.

Some embodiments of the disclosed methods comprise: de-coupling a financial transaction card from an upper hanging tab of a display that also comprises a lower enclosure detachably coupled to the hanging tab and defining an opening, and a card holder movably disposed within the enclosure and accessible through the opening, the card holder configured to be releasably coupled to the financial transaction card; removing at least a portion of the card holder from the enclosure; coupling the financial transaction card to the card holder; and disposing the card holder in the enclosure. Some embodiments further comprise: scanning the financial transaction card. Some embodiments further comprise: closing a flap of the enclosure.

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the terms "substantially," "approximately," and "about" may be substituted with "within [a percentage] of" what is specified, where the percentage includes 0.1, 1, 5, 10, and 20 percent.

Further, a device or system that is configured in a certain way is configured in at least that way, but it can also be configured in other ways than those specifically described.

The terms "comprise" (and any form of comprise, such as "comprises" and "comprising"), "have" (and any form of have, such as "has" and "having"), "include" (and any form of include, such as "includes" and "including"), and "contain" (and any form of contain, such as "contains" and "containing") are open-ended linking verbs. As a result, an apparatus that "comprises," "has," "includes," or "contains" one or more elements possesses those one or more elements, but is not limited to possessing only those elements. Likewise, a method that "comprises," "has," "includes," or "contains" one or more steps possesses those one or more steps, but is not limited to possessing only those one or more steps.

Any embodiment of any of the apparatuses, systems, and methods can consist of or consist essentially of—rather than comprise/include/contain/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

The feature or features of one embodiment may be applied to other embodiments, even though not described or illustrated, unless expressly prohibited by this disclosure or the nature of the embodiments.

Some details associated with the embodiments described above and others are described below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. The figures are drawn to scale (unless otherwise noted), meaning the sizes of the depicted elements are accurate relative to each other for at least the embodiment depicted in the figures.

DETAILED DESCRIPTION OF ILLUSTRATIVE EMBODIMENTS

Figure 1A:
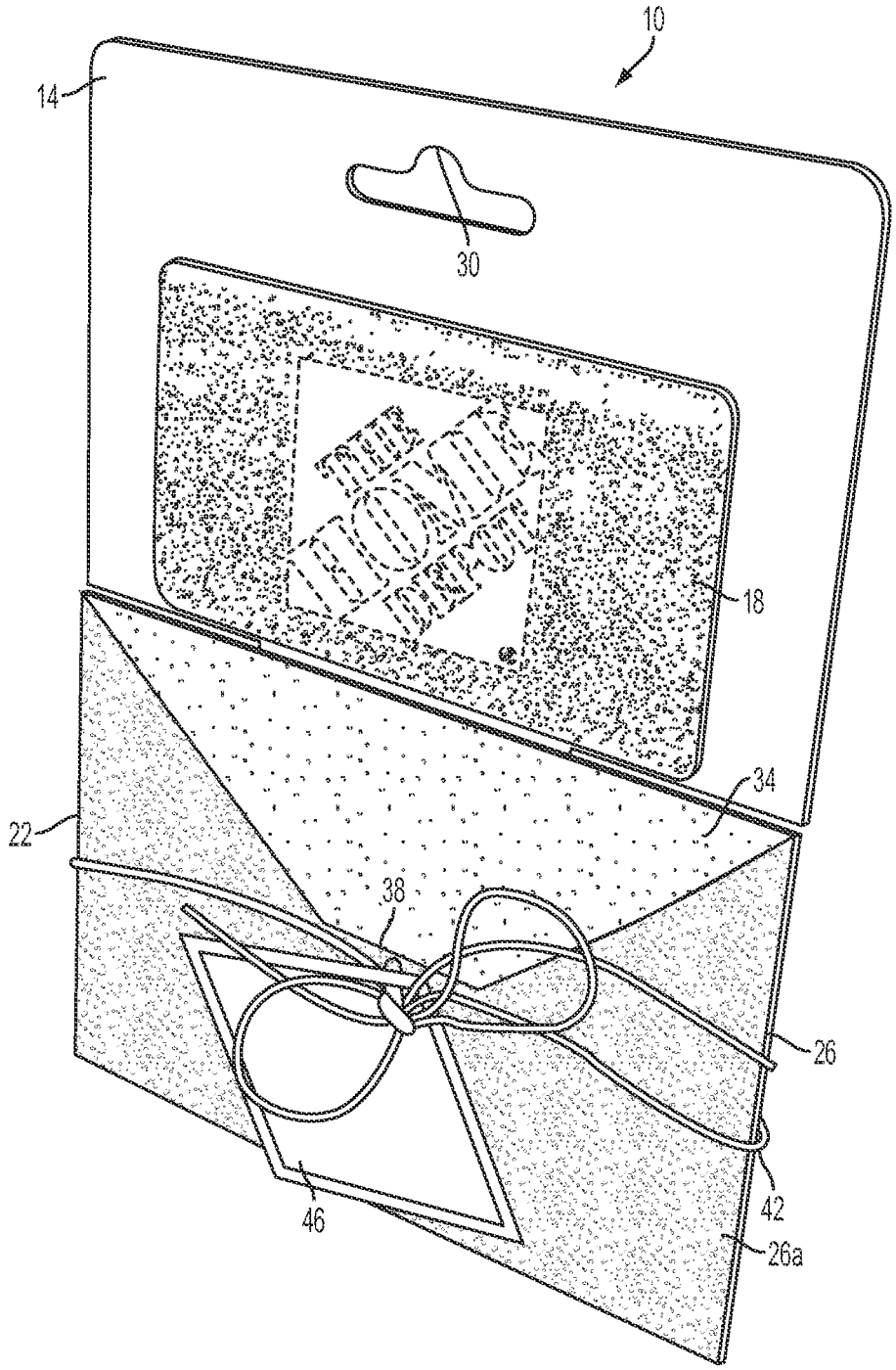
FIG. 1A depicts a front perspective view of a first embodiment of a gift card display.
Figure 1B:
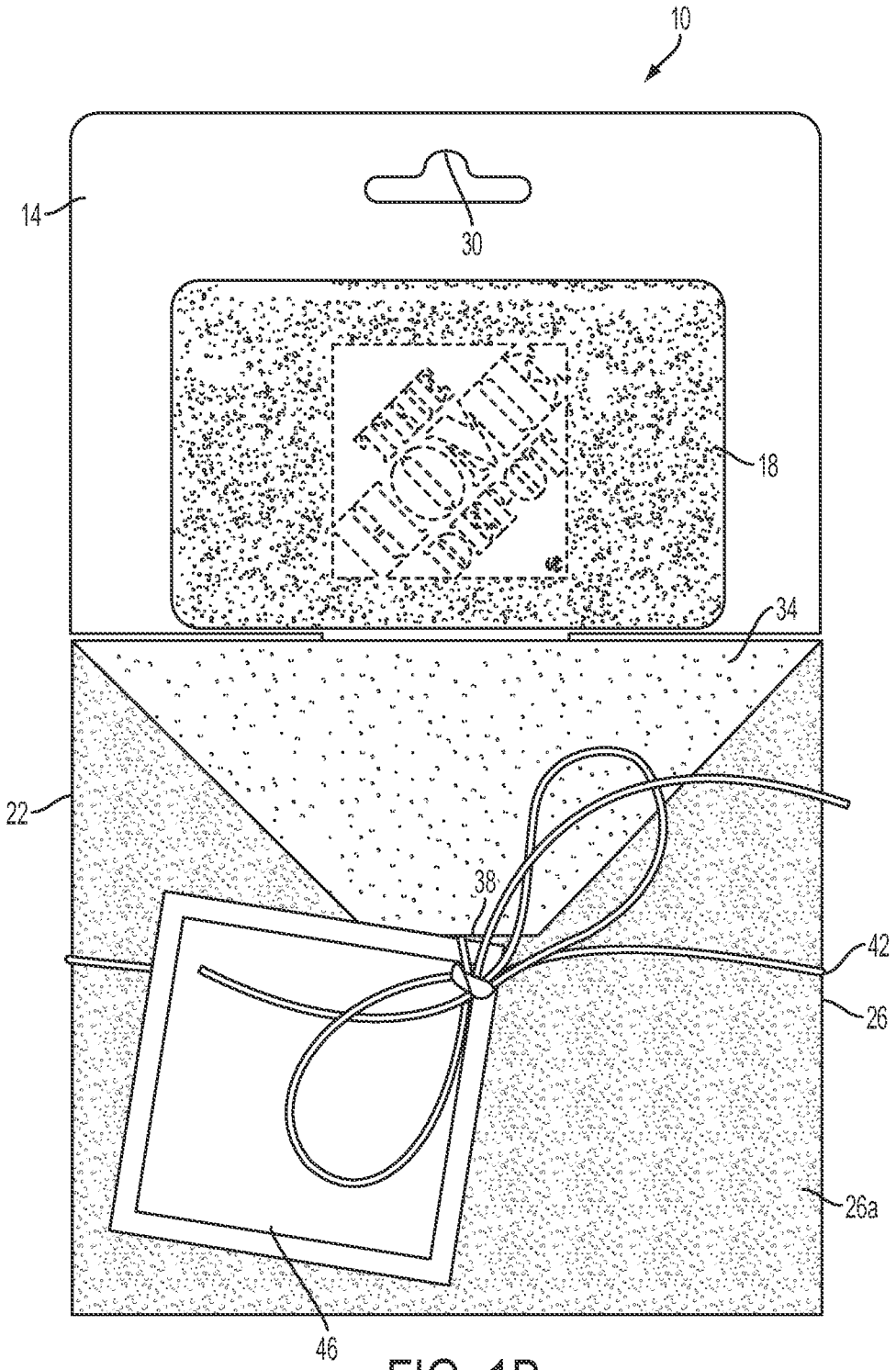
FIGS. 1B and 1C depict front and back views, respectively, of the first embodiment.

Referring now to the drawings, and more particularly to FIGS. 1A-1E, shown therein and designated by the reference numeral 10 is a first embodiment of a financial transaction card display. In the embodiment shown, display 10 comprises a hanging tab or member 14 configured to be releasably coupled to a financial transaction (e.g., gift) card. For example, in the embodiment shown, display 10 comprises a card 18 releasably coupled to hanging tab 14 (e.g., with an adhesive disposed between card 18 and hanging tab 14). In this embodiment, the adhesive is releasable such that card 18 can be removed from hanging tab 14 without damage to the card (e.g., or the hanging tab), but strong enough to retain card 18 against the force of gravity (e.g., while hanging) and against forces that may be experienced during shipping to prevent the card from becoming inadvertently dislodged or de-coupled from hanging tab 14. In other embodiments, card 18 can be releasable coupled to hanging tab 14 by any suitable structure (e.g., slots in and/or protrusions of hanging tab 14) that permits the functionality described in this disclosure, such as, for example, hook-and-loop fasteners, magnets, interlocking features (e.g., tabs), and/or the like.

In the embodiment shown, card 18 is releasably coupled to hanging tab 14 such that at least one identifying feature (e.g., a barcode 18*a*) is accessible (while card 18 is secured to hanging tab 14). For example, in the embodiment shown, hanging tab 14 comprises an opening 16 (FIG. 1C) such that when card 18 is coupled to hanging tab 14, as shown, barcode 18*a* can be accessed (e.g., is visible and can be scanned with a UPC scanner) through opening 16 without removing card 18 from hanging tab 14 (e.g., such that information associated with card 18 can be retrieved without removing the card from display 10). For example, a store employee can activate card 18 at purchase with minimal time and effort without removing the card from display 10 and thereby compromising the integrity of the display.

In the embodiment shown, display 10 comprises a rack hole 30 configured to allow placement and suspension of display 10 on a store rack (e.g., on a peg or hook of a store rack such that a customer may retrieve display 10 in order to purchase card 18). In this embodiment, display 10 comprises a single rack hole 30 near an upper edge of hanging tab 14 (e.g., opposite the edge of hanging tab 14 that is coupled to enclosure 22) that is substantially centered laterally on hanging tab 14, as shown, such that when display 10 is placed on a store rack (e.g., by placing a peg of a store rack through rack hole 30), the display hangs substantially vertically (e.g., such that the lower edge of enclosure 22 is substantially horizontal). In other embodiments, display 10 can comprise any number of rack holes (e.g., 30) that permits the functionality described in this disclosure, such as, for example, two rack holes (e.g., 30) in hanging tab 14 such that display 10 can be hung from two pegs of a store rack. In other embodiments, rack hole(s) may be omitted (e.g., where the display is configured to be disposed in slots of a store rack).

Figure 1C:
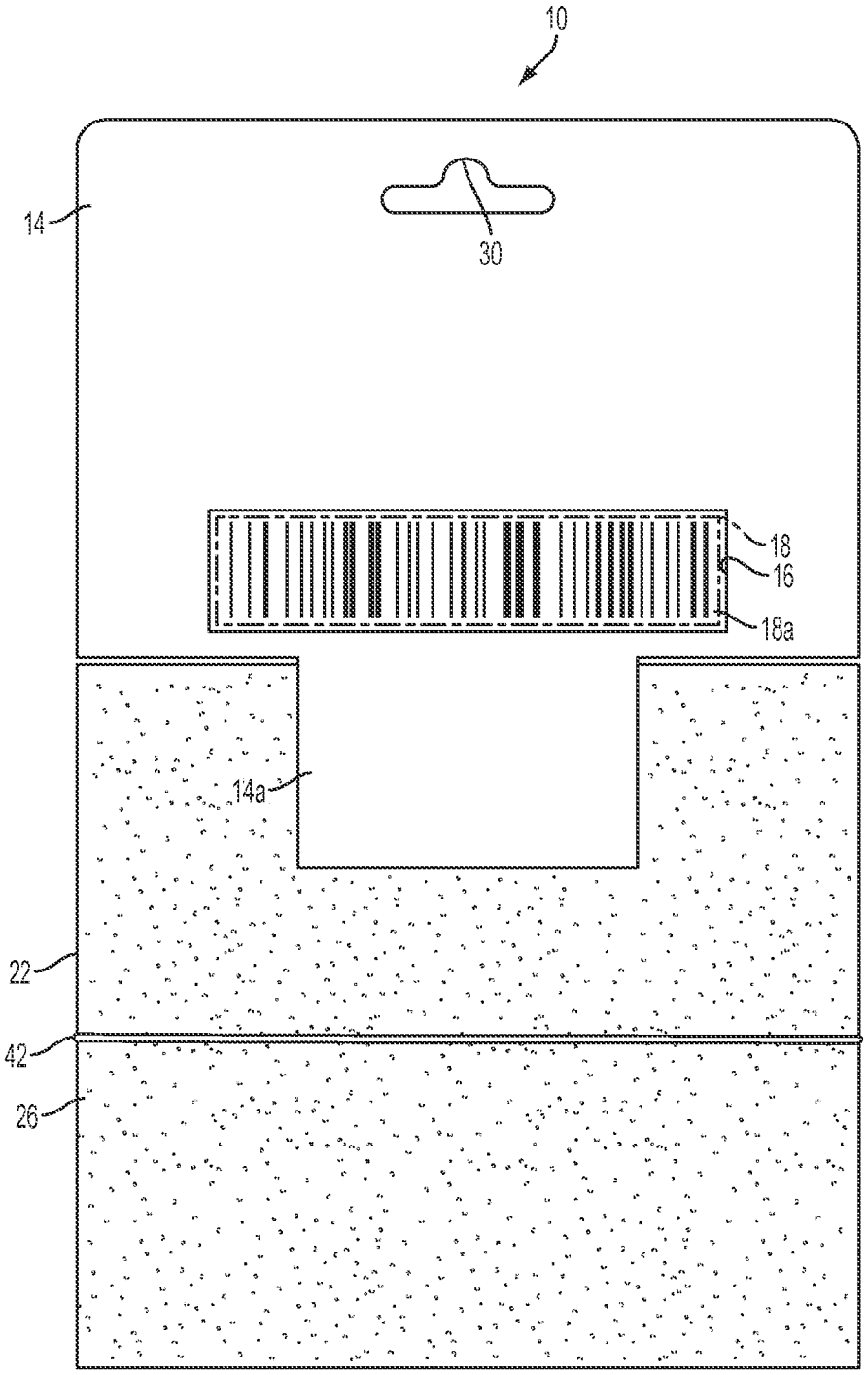
Figure 1D:
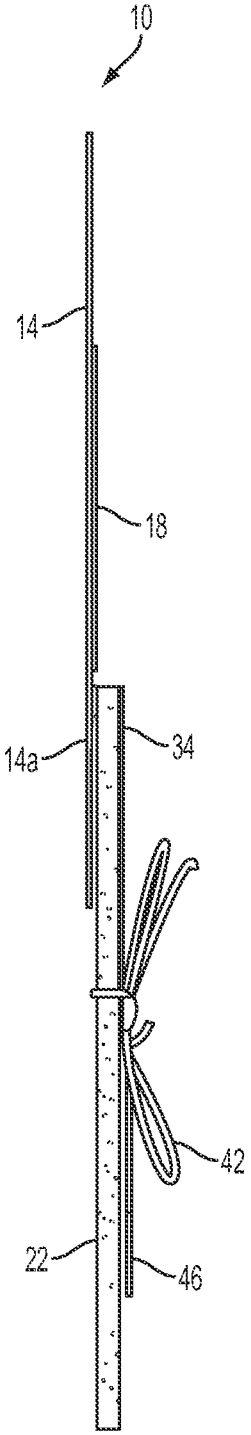
FIGS. 1D and 1E depict side views of the first embodiment.
Figure 1E:
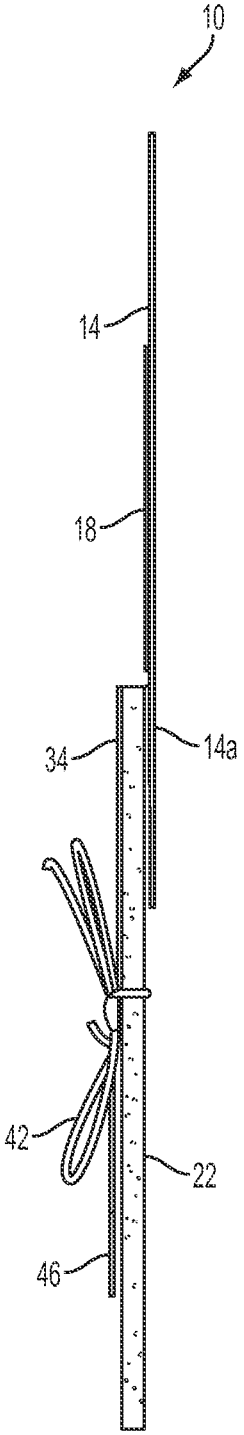
Figure 2:
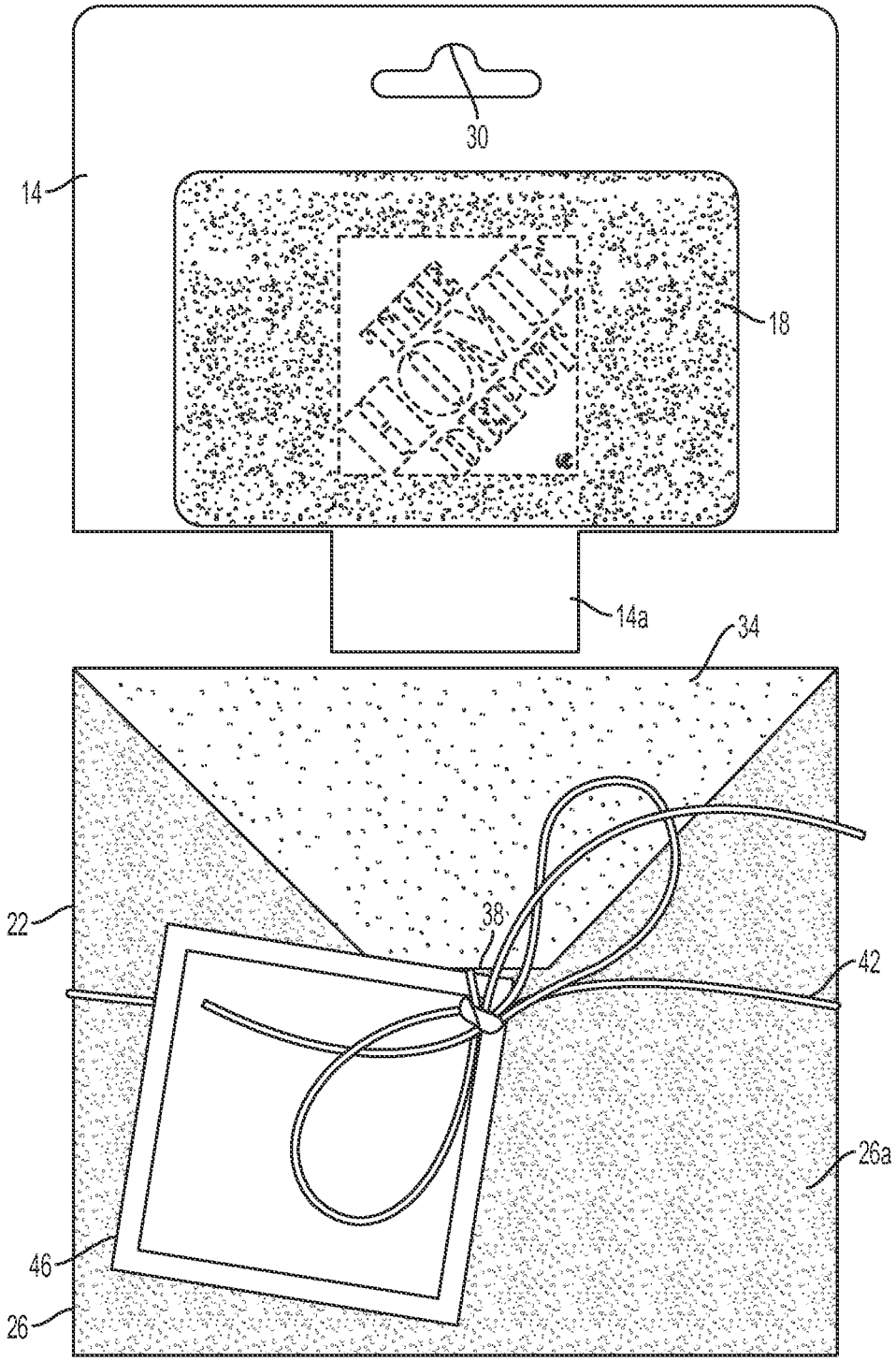
FIG. 2 depicts a front view of the first embodiment in which an upper hanging tab is detached from a lower enclosure.

In the embodiment shown, display 10 comprises a lower enclosure 22 that is removably coupled to hanging tab 14. For example, in this embodiment, hanging tab 14 is removably coupled to enclosure 22 by an adhesive (e.g., such as can be used between card 18 and hanging tab 14, as described above). In the embodiment shown, hanging tab 14 comprises a mounting portion 14*a* configured to extend below an upper edge of enclosure 22 and be adhered (or otherwise removably coupled to) a rear surface of enclosure 22 (as shown in FIG. 1C). Mounting tab 14*a* and/or enclosure 22 can comprise an adhesive (e.g., a pressure-sensitive and/or pressure-activated adhesive) such that when mounting portion 14*a* is pressed against enclosure 22 (e.g., during manufacturing of display 10) hanging tab 14 is removably coupled to enclosure 22. In this embodiment, the adhesive is releasable such that hanging tab 14 can be removed from enclosure 22 without damage to the enclosure (e.g., or the hanging tab) as shown in FIG. 2, but strong enough to retain enclosure 22 against the force of gravity (e.g., while hanging) and against forces that may be experienced during shipping to prevent the enclosure from becoming inadvertently dislodged from hanging tab 14. In other embodiments, hanging tab 14 (e.g., mounting portion 14*a*) can be removably coupled to enclosure 22 by any suitable structure that permits the functionality described in this disclosure, such as, for example, hook-and-loop fasteners, magnets, interlocking features (e.g., tabs), and/or the like. For example, in other embodiments, hanging tab 14 can be detachably attached to enclosure 22 along a perforated seam (e.g., where mounting portion 14*a* may be omitted). For example, hanging tab 14 and enclosure 22 can share a common sheet of material that is perforated (e.g., comprising a line of small indentations, detents, holes, and/or the like) to define a separable boundary between the tab and the enclosure that requires minimal effort (e.g., by a user pulling and/or tearing enclosure 22 away from hanging tab 14) and results in minimal damage to either portion during separation.

Referring also to FIGS. 3A-3D, in the embodiment shown, enclosure 22 comprises a body 26 having an opening 32 and a flap 34 that is movable between open (FIG. 3B) and closed (FIG. 3A) positions to selectively cover opening 32. In this embodiment, enclosure 22 (e.g., body 26) includes a slot 38 configured to releasably receive a portion of flap 34 to retain the flap in the closed position (e.g., with an end of flap 34 inserted into slot 38). In the embodiment shown, enclosure 22 is configured to removably receive a card holder 50 via opening 32 such that the card holder 50 (which is configured to be removably coupled to card 18) is movably (e.g., slidably) disposed within the enclosure and accessible through the opening. Enclosure 22 is configured such that when card 18 is coupled to card holder 50 and flap 34 is closed and secured in slot 38 (as in FIG. 3A), body 26 is configured to surround card 18 and/or card holder 50 on all sides. In this configuration, enclosure 22 provides a (e.g., aesthetically pleasing) package for gifting card 18, as well as prevent card 18 from becoming inadvertently dislodged from enclosure 22, regardless of the orientation of the enclosure (e.g., when transported by a user within a hand, pocket, wallet, purse, backpack, and/or the like). In the embodiment shown, enclosure 22 also comprises a ribbon or string 42 disposed around body 26 and tied in a bow (e.g., to further improve the desirability and/or aesthetic qualities of the package for gifting card 18). In some embodiments, ribbon or string 42 can retain and/or assist slot 38 in retaining flap 34 in a closed position (e.g., a portion flap 34 can be disposed underneath ribbon 42). In the embodiment shown, ribbon or string 42 comprises twine, however, in other embodiments, ribbon 42 can comprise any material which permits the functionality described in this disclosure, including, but not limited to, burlap, cotton, silk, and/or the like.

In some embodiments, at least one surface of enclosure 22 comprises a sandpaper texture. For example, in the embodiment shown, at least one surface 26*a* of body 26 comprises a sandpaper texture. The sandpaper texture can be provided by coupling (e.g., with adhesive) a sheet of sandpaper to the surface on which a sandpaper texture is desired, or can be provided by coupling (e.g., with adhesive) sand and/or other gritty material to the surface on which a sandpaper texture is desired (e.g., in a manner similar to any of those known for manufacturing sandpaper). In some embodiments, the sandpaper texture can be provided by imprinting a rough and/or gritty texture directly onto the surface on which a sandpaper texture is desired (e.g., with an imprinting machine). The sandpaper texture can further improve the desirability and/or aesthetic qualities of the package for gifting card 18. Additionally, the sandpaper texture can also increase friction between surface 26*a* and flap 34 to resist removal of flap 34 from slot 38 when the flap is in the closed position.

In the embodiment shown, display 10 comprises a gift tag 46. Gift tag 46 comprises a writable surface configured to allow a purchaser to provide an individualized gift message to a recipient (e.g., a surface that is smooth and relatively absorbent such that liquid ink delivered by a writing utensil dries relatively quickly and is substantially resistant to smudging). In the embodiment shown, gift tag 46 is secured to body 26 by ribbon 42, however, in other embodiments, gift tag 46 may be directly affixed to body 26 (e.g., a sticker label). In some embodiments, the disclosed displays do not comprise a gift tag 46, and personalized messages may be written on a writable surface (e.g., similar to the writable surface of gift tag 46 described above), disposed on enclosure 22, body 26, card 18, and/or card holder 50.

Figure 3B:
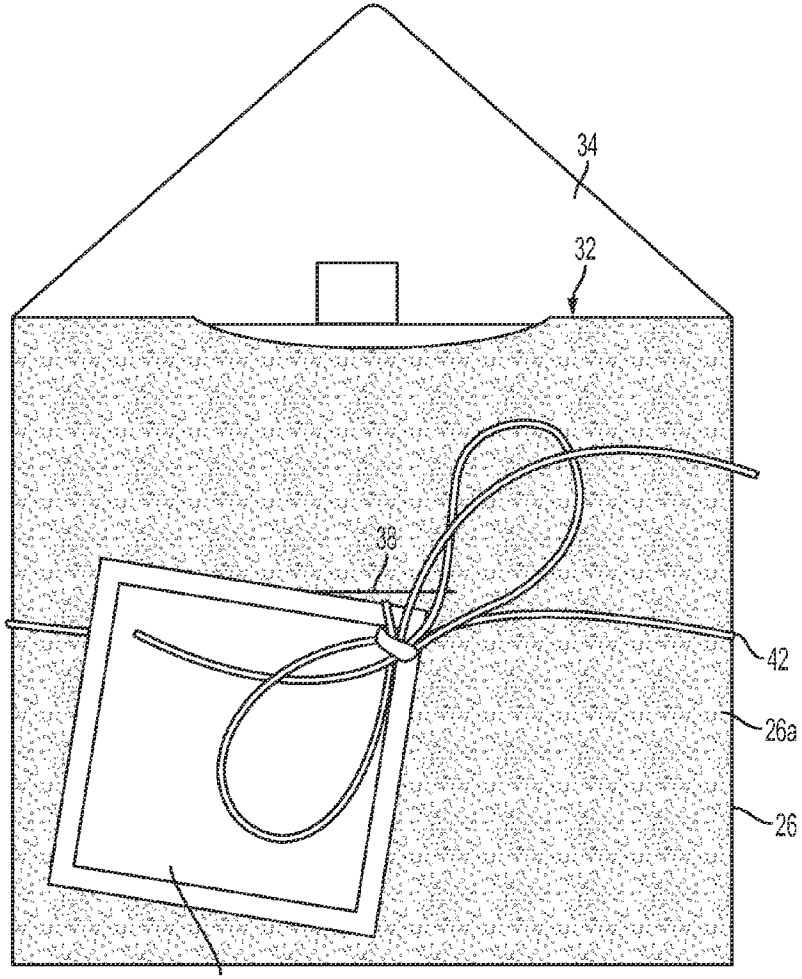
FIGS. 3A through 3D depict the removal of a card holder from the enclosure of the first embodiment.
Figure 3A:
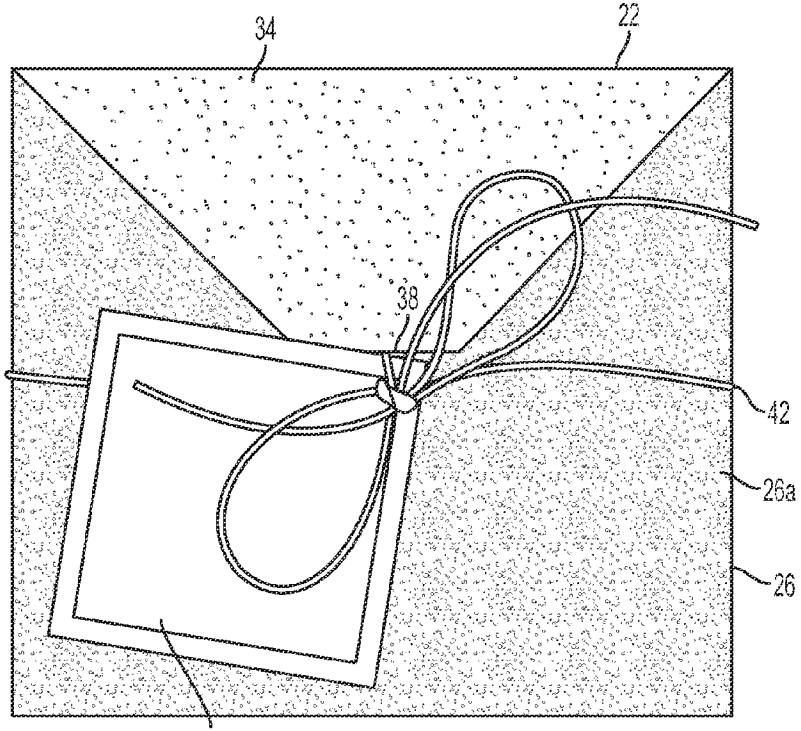
Figure 3C:
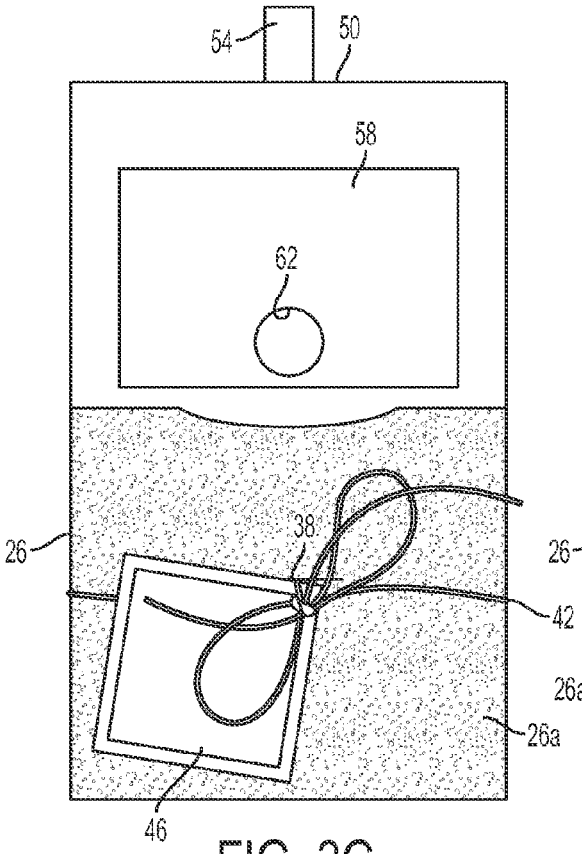
Figure 3D:
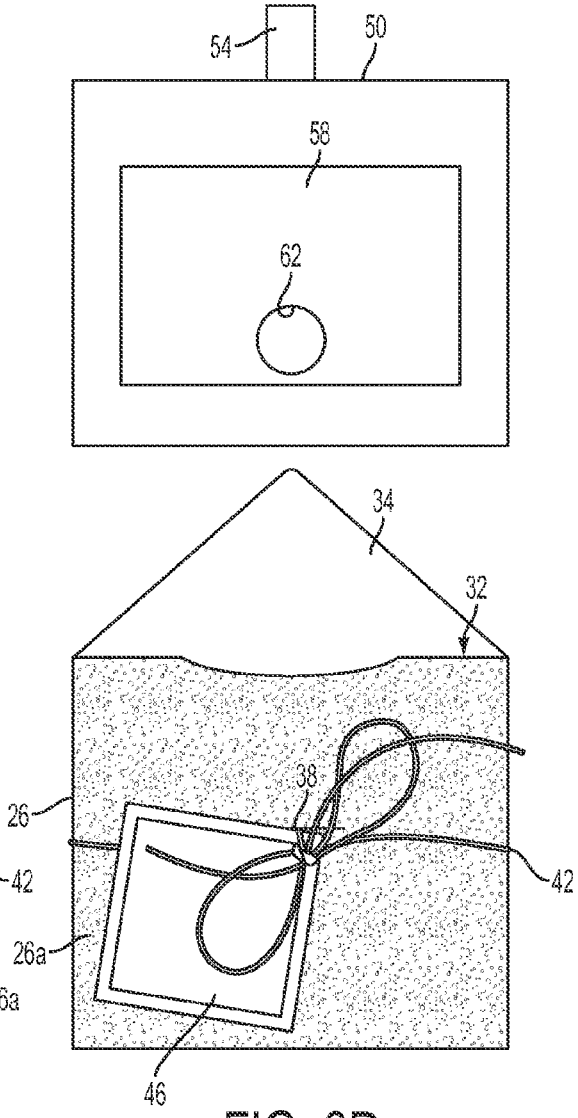
Figure 4B:
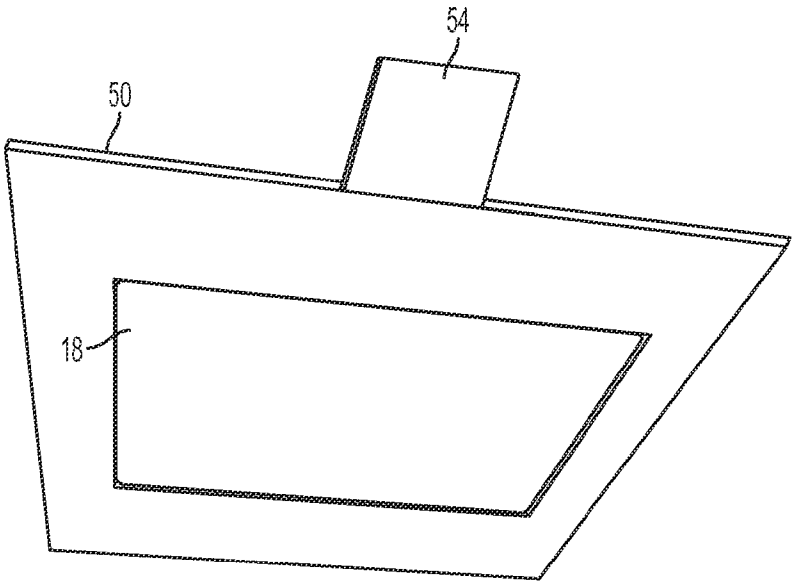
FIGS. 4A and 4B depict front perspective views of the card holder of the first embodiment with and without a gift card disposed in a recess of the card holder.
Figure 4A:
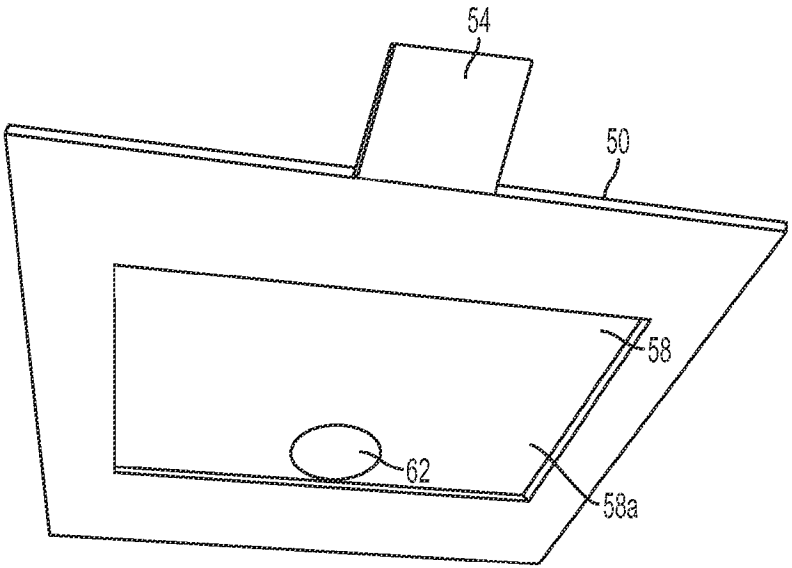

FIGS. 4A and 4B depict card holder 50 with and without card 18, respectively. In this embodiment, card holder 50 comprises a tab 54 configured to facilitate removal of the card holder from the enclosure. As noted above, card holder 50 is configured to be releasably coupled to card 18 (e.g., after card 18 has been removed from hanging tab 14, for example, by a customer after purchase to prepare card 18 for gifting, as shown in FIGS. 3A through 3D). In the embodiment shown, for example, card holder 50 comprises a rectangular recess 58 with dimensions just larger than those of card 18 such that card 18 can be disposed within recess 58 (as in FIG. 4B). In other embodiments, card 18 can be pressed into recess 58 and a friction fit between the outer edges of the card and the interior sides of the recess can resist removal of the card from the recess. In other embodiments, card holder 50 can be configured to be coupled to card 18 by any suitable structure (e.g., slots in and/or protrusions of card holder 50) that permits the functionality described in this disclosure, such as, for example, hook-and-loop fasteners, magnets, interlocking features (e.g., tabs), and/or the like. For example, in some embodiments, card holder 50 can comprise an adhesive that permits card 18 to be pressed onto and retained on card holder 50 to retain card 18 against the force of gravity (e.g., while hanging) and against forces that may be experienced during shipping to prevent the card from becoming inadvertently dislodged from card holder 50, while still permitting a user to easily remove the card from the card holder. Such an adhesive can be substantially similar to that described above for releasably coupling card 18 to hanging tab 14. In the embodiment shown, recess 58 comprises a surface 58*a* that is configured to receive liquid ink from a writing utensil such that the ink is substantially resistant to smudging (e.g., substantially similar to that described above for gift tag 46). In the embodiment shown, card holder 50 also comprises a hole 62 extending into recess 58 and configured to facilitate removal of card 18 from recess (e.g., such that a user's finger, a pen, or other object can be extended through hole 62 to press card out of recess 58 and away from card holder 50).

In use (e.g., after a user purchases a display 10 having a card 18), upper hanging tab 14 can be removed from lower enclosure 22, as illustrated in FIG. 2, and card 18 can be removed from hanging tab 14. A user can remove flap 34 from slot 38 and move flap 34 from the closed position of FIG. 3A to the open position of FIG. 3B. The user may then pull tab 54 to slide at least part of card holder 50 out of body 26 through opening 32 to access recess 58 (e.g., as shown in FIGS. 3C-3D). Card 18 can then be disposed in recess 58 of card holder 50 and card holder 50 can be slid back into enclosure 22 and flap 34 returned to the closed position and inserted into slot 38, such that enclosure 22 provides a package suitable for gifting card 18.

The above specification and examples provide a complete description of the structure and use of illustrative embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the methods and systems are not intended to be limited to the particular forms disclosed. Rather, they include all modifications and alternatives falling within the scope of the claims, and embodiments other than the one shown may include some or all of the features of the depicted embodiment. For example, elements may be omitted or combined as a unitary structure, and/or connections may be substituted. Further, where appropriate, aspects of any of the examples described above may be combined with aspects of any of the other examples described to form further examples having comparable or different properties and/or functions, and addressing the same or different problems. Similarly, it will be understood that the benefits and advantages described above may relate to one embodiment or may relate to several embodiments.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. A display for a financial transaction card, the display comprising:

an upper hanging tab configured to be releasably coupled to a financial transaction card;

a lower enclosure detachably coupled to the hanging tab, the lower enclosure comprising a back panel, a front panel, and a flap, wherein the front panel is partially joined to the back panel to form an envelope having an opening, wherein the flap is movable between open and closed positions to selectively cover the opening, wherein the front panel includes a slot configured to releasably receive a portion of the flap to retain the flap in the closed position, wherein the portion of the flap comprises a sandpaper texture, and wherein a width of the portion of the flap does not exceed a width of the slot; and a card holder movably disposed within the enclosure and accessible through the opening, the card holder configured to be releasably coupled to a financial transaction card.

2. The display of claim 1, where the hanging tab is configured to be releasably coupled to the financial transaction card such that at least one identifying feature of the financial transaction card is accessible.

3. The display of claim 1, where the hanging tab is coupled to the enclosure by an adhesive.

4. The display of claim 1, where the hanging tab is coupled to the enclosure along a perforated seam.

5. The display of claim 1, comprising a ribbon or string disposed around the enclosure.

6. The display of claim 5, further comprising a gift tag coupled to the ribbon or string.

7. The display of claim 1, where at least one surface of the flap comprises a sandpaper texture.

8. The display of claim 1, where the card holder comprises a tab configured to extend out of the opening when the card holder is disposed in the enclosure to facilitate removal of the card holder from the enclosure.

9. The display of claim 1, where the card holder comprises a recess configured to removably receive the financial transaction card.

10. The display of claim 9, where the recess comprises a surface configured to receive ink from a writing utensil.

11. The display of claim 9, where the recess comprises a hole configured to facilitate removal of the financial transaction card from the card holder.

12. The display of claim 1, where the card holder comprises an adhesive configured to releasably couple the financial transaction card to the card holder.

13. The display of claim 1, further comprising a financial transaction card releasably secured to the hanging tab by an adhesive.

14. The display of claim 1, wherein the flap is substantially triangular.

15. The display of claim 1, wherein the front panel and the back panel are substantially rectangular, and wherein the front panel is affixed to the back panel along three sides.

16. An apparatus comprising:

an enclosure, the enclosure comprising a back panel, a front panel, and a flap, wherein the front panel is partially joined to the back panel to form an envelope having an opening, wherein the flap is movable between open and closed positions to selectively cover the opening, wherein the front panel includes a slot configured to releasably receive a portion of the flap to retain the flap in the closed position, wherein the portion of the flap comprises a sandpaper texture, and wherein a width of the portion of the flap does not exceed a width of the slot; and a slot configured to releasably receive a portion of the flap to retain the flap in the closed position; and a card holder movably disposed within the enclosure and accessible through the opening, the card holder configured to be releasably coupled to a financial transaction card.

17. The apparatus of claim 16, where the card holder comprises a recess configured to receive the financial transaction card, and the apparatus further comprises:

a financial transaction card removably received within the recess of the card holder.

18. A display for a financial transaction card, the display comprising:

an upper hanging tab;

a financial transaction card releasably secured to a first side of the hanging tab by an adhesive;

a lower enclosure (i) detachably coupled to the first side of the hanging tab or (ii) coupled to the hanging tab along a perforated seam, the lower enclosure comprising a back panel, a front panel, and a flap, wherein the front panel is partially joined to the back panel to form an envelope having an opening, wherein the flap is movable between open and closed positions to selectively cover the opening, wherein the front panel includes a slot configured to releasably receive a portion of the flap to retain the flap in the closed position, wherein the portion of the flap comprises a sandpaper texture, and wherein a width of the portion of the flap does not exceed a width of the slot; and a card holder movably disposed within the enclosure and accessible through the opening, the card holder configured to be releasably coupled to a financial transaction card.

19. The display of claim 18, wherein the lower enclosure does not overlap with the financial transaction card on the hanging tab.

20. The display of claim 18, wherein the tab defines an opening through which a feature of the financial transaction card is visible.

* * * * *